US008971154B2

(12) United States Patent
Wei

(10) Patent No.: US 8,971,154 B2
(45) Date of Patent: Mar. 3, 2015

(54) SYNCHRONIZATION OF SYSTEM TIME IN ELECTRONIC DEVICE

(75) Inventor: Zhiyu Wei, Beijing (CN)

(73) Assignee: IGRS Engineering Lab Ltd., Haidian District, Beijing ( * ) Notice: Subject to any disclaimer, the term of this patent is extended or adjusted under 35 U.S.C. 154(b) by 1162 days.

(21) Appl. No.: 12/502,933

(22) Filed: Jul. 14, 2009

(65) Prior Publication Data

US 2011/0013489 A1 Jan. 20, 2011

(51) Int. Cl.

| | |
|---|---|
| ***G04C 13/00*** | (2006.01) |
| ***G04G 19/08*** | (2006.01) |
| ***G04R 20/00*** | (2013.01) |

(52) U.S. Cl.

CPC ..... *G04G 19/08* (2013.01); *G04R 20/00* (2013.01)

USPC ..... 368/47

(58) Field of Classification Search

USPC ..... 368/46–47; 455/193.1; 342/357.2

See application file for complete search history.

(56) References Cited

U.S. PATENT DOCUMENTS

| | | | | |
|---|---|---|---|---|
| 713,500 | A | 11/1902 | Rush | |
| 6,009,530 | A | 12/1999 | Goatly | |
| 6,427,120 | B1 * | 7/2002 | Garin et al. | 701/213 |
| 7,376,050 | B2 * | 5/2008 | Yanase | 368/10 |
| 7,474,594 | B2 * | 1/2009 | Urano et al. | 368/47 |
| 7,515,887 | B2 * | 4/2009 | Saitoh | 455/191.1 |
| 7,518,958 | B2 * | 4/2009 | Ishii | 368/47 |
| 7,720,452 | B2 * | 5/2010 | Miyahara et al. | 455/191.1 |
| 2006/0234671 | A1 * | 10/2006 | Gamo et al. | 455/403 |
| 2007/0113068 | A1 | 5/2007 | Lee | |
| 2007/0230284 | A1 * | 10/2007 | Singhi | 368/46 |
| 2008/0244301 | A1 | 10/2008 | Shih | |
| 2010/0195448 | A1 * | 8/2010 | Shemesh et al. | 368/47 |

* cited by examiner

*Primary Examiner* — Sean Kayes

(74) *Attorney, Agent, or Firm* — Brundidge & Stanger, P.C.

(57) ABSTRACT

A method and apparatus for synchronizing a system time in an electronic device are provided. The method may include: when the electronic device is executing a boot process, disabling an external time obtaining function of the electronic device for obtaining an external reference time, obtaining an internal clock time from an internal clock unit of the electronic device and synchronizing a system time of the electronic device with the internal clock time; and when the electronic device has completed the boot process, enabling the external time obtaining function to obtain the external reference time.

19 Claims, 5 Drawing Sheets

SYNCHRONIZATION OF SYSTEM TIME IN ELECTRONIC DEVICE

TECHNICAL FIELD

The present disclosure relates to the field of electronic devices, and more particularly to synchronization of system time in an electronic device.

BACKGROUND ART

An electronic device, such as an embedded device, is generally provided with an internal clock unit, for example, a Real Time Clock (RTC) unit. The RTC is a machine clock (most often in the form of an integrated circuit) that keeps track of the current time. Although the term often refers to the units in personal computers, servers and embedded systems, RTCs are present in almost any electronic device which needs to keep accurate time, such as a digital camera, a Personal Digital Assistance (PDA), a mobile phone, a home appliance and the like. RTCs often have an alternate source of power, so they can continue to keep time while the primary source of power is off or unavailable.

In many electronic devices, a system time is needed for a time displaying function or for running time-sensitive applications, for example, applications updating a virus library of anti-virus software. The time read from the RTC is usually utilized as the system time of the electronic devices.

SUMMARY

An embodiment of the present disclosure provides a method for synchronizing a system time in an electronic device. The method may include: when the electronic device is executing a boot process, disabling an external time obtaining function of the electronic device for obtaining an external reference time, obtaining an internal clock time from an internal clock unit of the electronic device and synchronizing a system time of the electronic device with the internal clock time; and when the electronic device has completed the boot process, enabling the external time obtaining function to obtain the external reference time.

Another embodiment of the present disclosure provides an apparatus for synchronizing a system time in an electronic device. The apparatus may include an external time obtaining module, adapted to obtain an external reference time; an internal clock time obtaining module, adapted to obtain an internal clock time from an internal clock unit of the electronic device and use the internal clock time as a system time of the electronic device; and a control module, adapted to disable the external time obtaining module when the electronic device is executing a boot process, and enable the external time obtaining module when the electronic device has completed the boot process to obtain the external reference time.

Another embodiment of the disclosure provides a program product, stored on a computer readable medium, including machine-executable instructions which, when executed by a processor of an information processing device, causes the information processing device to perform the method described above.

Another embodiment of the disclosure provides a machine-readable medium having machine-readable program code embodied therein for causing an information processing device to perform the method described above.

The foregoing is a summary and thus contains, by necessity, simplifications, generalization, and omissions of detail(s). Consequently, those skilled in the art will appreciate that the summary is illustrative only and is not intended to be in any way limiting. Other aspects, features, and advantages of the apparatus and/or processes and/or other subject matter described herein will become apparent in the teachings set forth herein. The summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the present disclosure and are, therefore, not to be considered limiting of its scope, the present disclosure will be described with additional specificity and detail through use of the accompanying drawings.

DESCRIPTION OF EMBODIMENTS

Figure 1:
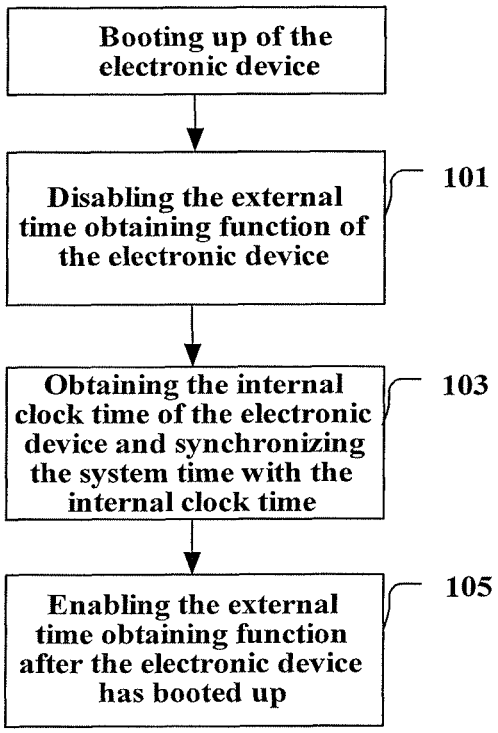
FIG. 1 is a schematic flow chart illustrating a method for synchronizing a system time of an electronic device according to an embodiment of the present disclosure.

In the following detailed description, reference is made to the accompanying drawings, which form a part hereof. In the drawings, similar symbols typically identify similar components, unless the context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to methods, apparatus, computer-readable mediums having a set of instructions stored thereon, and program products related to synchronization of system time in an electronic device.

The system time of an electronic device, e.g. an embedded electronic device (such as a digital camera, a Personal Digital Assistance (PDA), a mobile phone, and a home appliance, etc.), provided by an internal clock unit, such as a Real Time Clock (RTC) unit may be inaccurate. To synchronize the system time, the electronic device may be provided with an external time obtaining function to obtain an external reference time, so that the system time of the electronic device may be synchronized with the obtained external reference time.

The external reference time may be obtained by the external time obtaining function, for example, from an external device/system connected with the electronic device. The electronic device may be connected to the external device/system in a wired or wireless manner according to any appropriate technology, the description of which is omitted here. The process of obtaining an external reference time may be implemented using any appropriate technologies. For example, the external time obtaining function may obtain the external reference time via a communication network connected thereto. In an example, the external time obtaining function may invoke a Network Time Protocol (abbreviated as NTP, which is a protocol for synchronizing the clocks of computer systems over packet-switched, variable-latency data networks) service via the communication network to obtain an NTP time as the external reference time. In another embodiment, the external time obtaining function may invoke a Global Position System (GPS) service, e.g. by using a GPS receiving device associated with the electronic device, to obtain a GPS time as the external reference time. For example, the GPS receiving device may be built in the electronic device. In this case, the external time obtaining function may obtain the GPS time directly from the GPS receiving device. Alternatively, the GPS receiving device may be separated from but connected with the electronic device, for example, via a communication network. In this case, the external time obtaining function may obtain the GPS time from the GPS receiving device via the communication network.

FIG. 1 illustrates a method for synchronizing a system time of an electronic device having an external time obtaining function for obtaining an external reference time from an external device/system connectable to the electronic device according to an embodiment of the present disclosure. As shown in FIG. 1, the method may include the following steps:

Step 101. When the electronic device is booting up, namely, executing a boot process, the external time obtaining function of the electronic device is disabled.

Step 103. An internal clock unit (e.g. a RTC unit) of the electronic device is read to give an internal clock time. The internal clock time is used as the system time of the electronic device.

Step 105. When the electronic device has booted up, namely, completed the boot process, the disabled external time obtaining function is enabled, so that the external time obtaining function may be performed to obtain the external reference time.

When an electronic device is booting up, its connection with the external device/system may be unavailable, for example, the connection may have not been established or may be unstable. Therefore, if the external time obtaining function is performed during execution of the boot process, it may take a long time to obtain the external reference time. Thus, a fault, such as a system failure, may occur in the electronic device, thereby decreasing the speed of the boot process. Accordingly the performance of the electronic device may be degraded. In the embodiment, the external time obtaining function of the electronic device is disabled when the electronic device is booting up. In other words, the obtaining of an external reference time is delayed until the electronic device has booted up and its connection with the external device/system becomes stable. Instead of obtaining the external reference time, the electronic device may use an internal clock time as its system time during the booting up. This reduces the probability of fault in the electronic device during the boot process without decreasing the boot-up speed.

Figure 2:
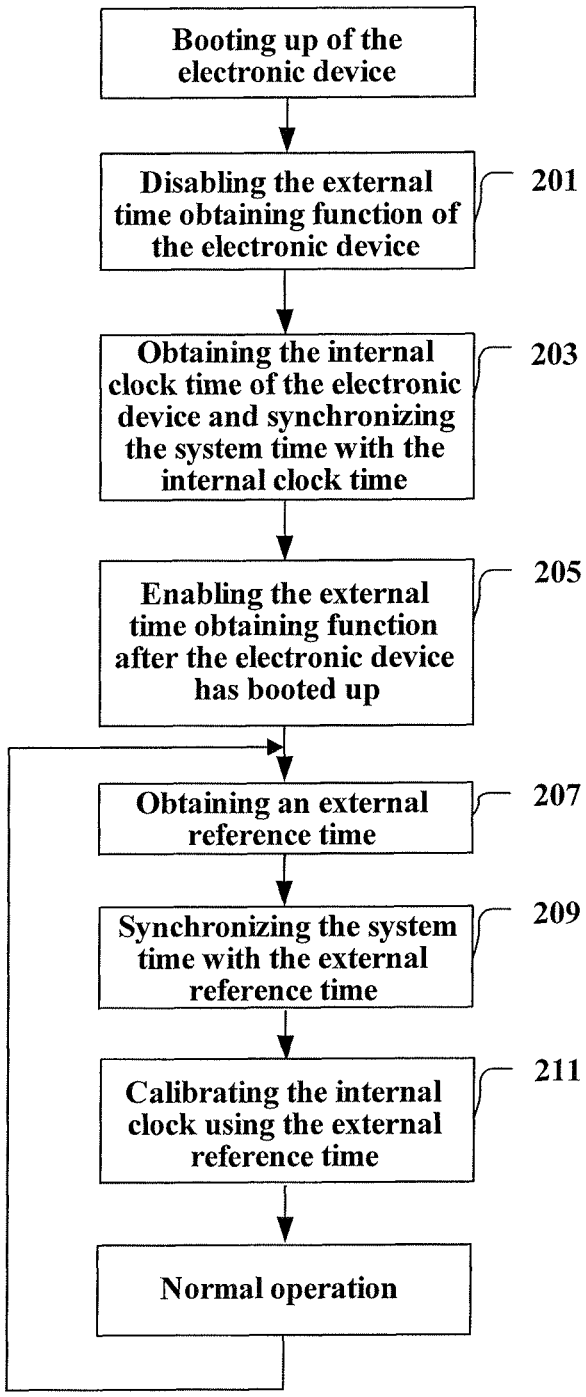
FIG. 2 is a schematic flow chart illustrating a method for synchronizing a system time of an electronic device according to another embodiment of the present disclosure.

FIG. 2 illustrates a method for synchronizing a system time of an electronic device according to another embodiment of the present disclosure. In the method as shown in FIG. 2, the steps 201, 203, and 205 are similar to the steps 101, 103, and 105 as shown in FIG. 1 and are not repeated herein.

In step 207, the external time obtaining function is enabled to obtain an external reference time.

If the external reference time is obtained, the system time of the electronic device may be synchronized with the obtained external reference time as shown in step 209 and the internal clock time may be calibrated using the obtained external reference time as shown in Step 211 The electronic device continues to use the internal clock time as its system time until the external reference time is obtained. In an example, the internal clock time may be calibrated by writing the obtained external reference time into the internal clock unit, e.g. the RTC unit, of the electronic device. In this way, the electronic device may get a more accurate internal clock time when booting up next time.

In the embodiment, the steps 207, 209, and/or 211 may be performed repeatedly, for example, the steps may be performed periodically or at predefined time point(s) configured in the electronic device. Alternatively, these steps may be initiated in response to receipt of an external command, for example, inputted by a user of the electronic device, for example, by receiving an indication of a pressing of a button on the electronic device or by receiving a command at the electronic device. In this way, the system time of the electronic device may be kept synchronized with the external reference time.

In another embodiment, the external time obtaining function may obtain the external reference time via a communication network. In an example, the external time obtaining function may invoke an NTP service via the communication network to obtain an NTP time as the external reference time. In another example, the external time obtaining function may invoke a GPS service, e.g. by using a GPS receiving device associated with the electronic device, to obtain a GPS time as the external reference time.

Figure 3:
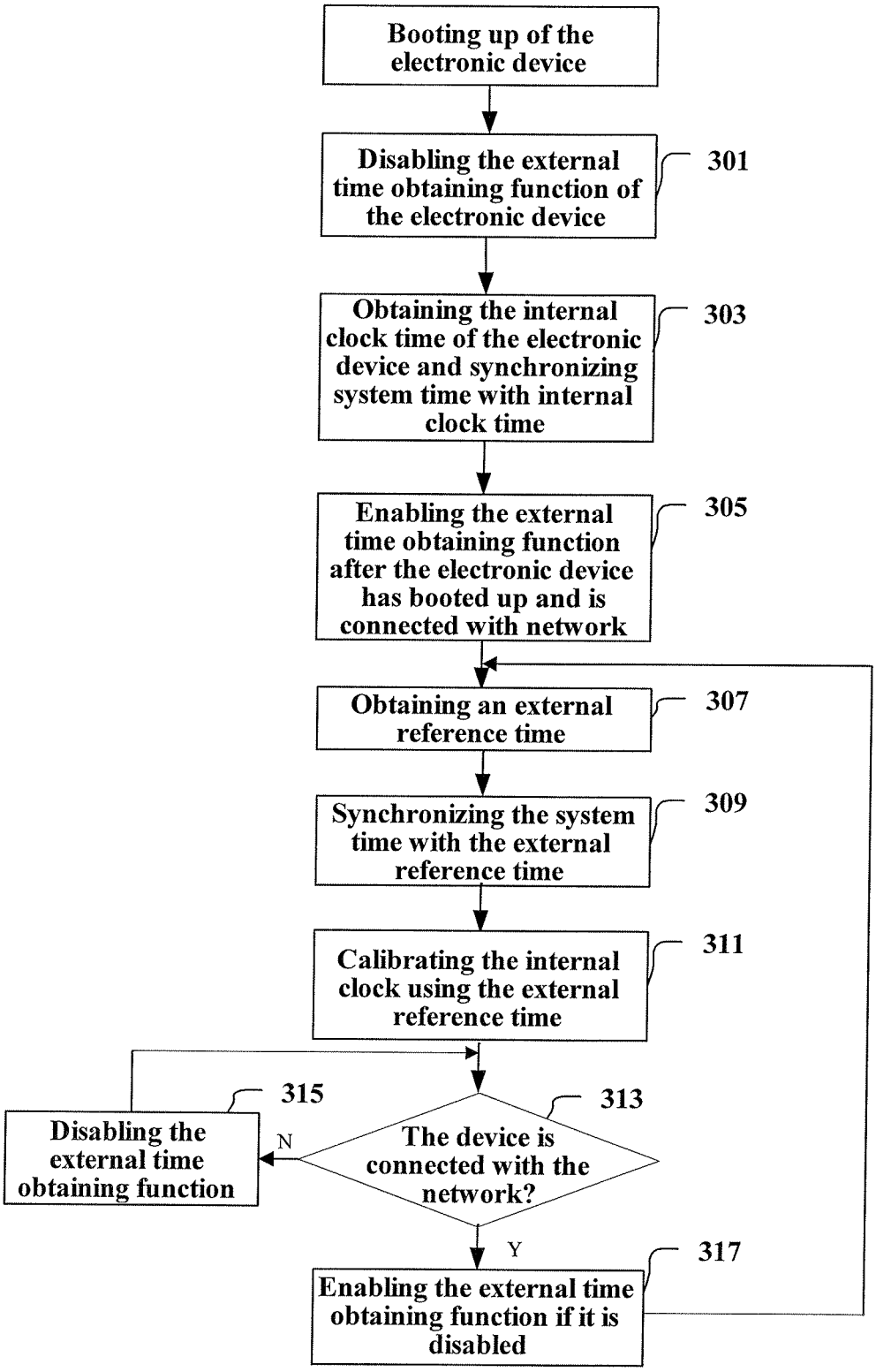
FIG. 3 is a schematic flow chart illustrating a method for synchronizing a system time of an electronic device according to another embodiment of the present disclosure.

FIG. 3 illustrates a method for synchronizing a system time of an electronic device according to another embodiment of the present disclosure. In the embodiment, the electronic device has a communication device connectable with the communication network. In addition, the electronic device has an external time obtaining function which may obtain an external reference time from an external device/system via the communication network.

In the method as shown in FIG. 3, the steps 301-311 are similar to the steps 201-211 as shown in FIG. 2 and the description thereof is omitted here.

In step 313, the connection between the electronic device and the communication network is monitored. If the electronic device becomes disconnected from the communication network, the external time obtaining function is disabled in step 315. When the electronic device resumes its connection with the communication network, the external time obtaining function is enabled again as shown in step 317.

In the embodiment, the external time obtaining function is disabled when the connection between the electronic device and the communication network fails. In this way, the resources of the electronic device may be saved, and accordingly the performance of the electronic device may be improved.

Figure 4:
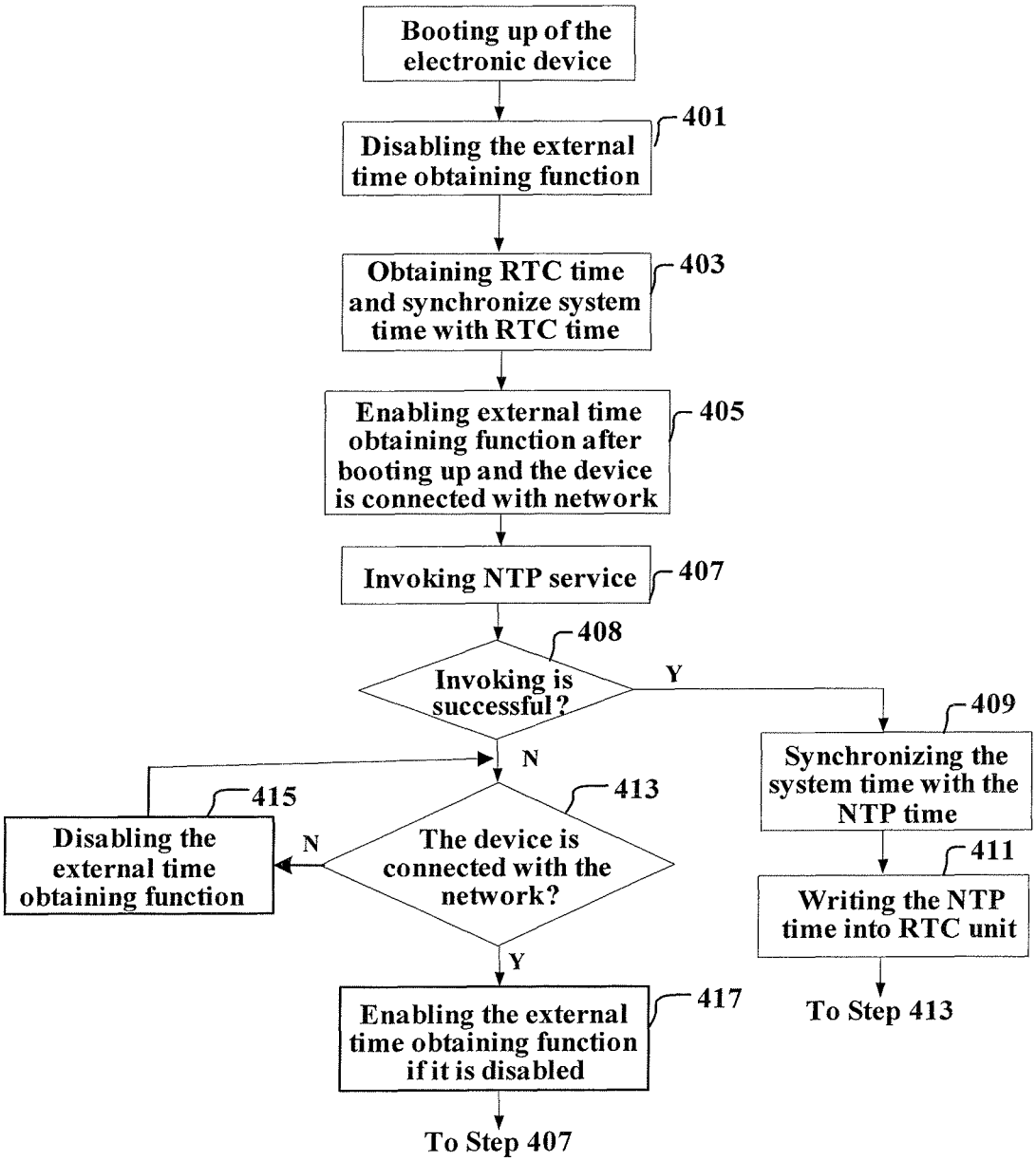
FIG. 4 is a schematic flow chart illustrating a method for synchronizing a system time of an electronic device with a Network Time Protocol (NTP) time according to another embodiment of the present disclosure.

FIG. 4 illustrates an example of a method for synchronizing a system time of an electronic device with a Network Time Protocol (NTP) time. In the example, the electronic device has a communication device connectable with a communication network. In addition, the electronic device has an external time obtaining function which may invoke an NTP service via the communication network to obtain an NTP time.

As shown in FIG. 4, in step 401, the external time obtaining function is disabled when the electronic device is booting up. In other words, the invoking of the NTP service is disabled. In step 403, the internal clock unit of the electronic device, in this example, an RTC unit, is read to give an RTC time. The RTC time is used as the system time of the electronic device. In step 405, after the electronic device has booted up and its connection with the communication network is established, the external time obtaining function is enabled. In step 407, the external time obtaining function is performed, i.e. the electronic device invokes the NTP service over the communication network. In step 408, it is judged whether the invoking of the NTP service is successful, i.e. whether an NTP time is obtained. If yes, the system time of the electronic device is synchronized with the obtained NTP time as shown in step 409 and the NTP time is written into the RTC unit of the electronic device as shown in step 411. Then step 413 is performed.

In step 413, it is detected whether the electronic device is connected with the communication network. If the electronic device is not connected with the communication network, the external time obtaining function is disabled again as shown in step 415. After the electronic device resumes its connection with the communication network, the external time obtaining function is enabled again as shown in step 417.

The NTP service may be invoked periodically or be performed at predefined time point(s) configured in the electronic device. Alternatively, the invoking may be initiated based on an indication received from a user at the electronic device, for example, by receiving an indication of a pressing of a button on the electronic device or by receiving a command at the electronic device.

In an example, the system time may be written into the internal clock unit (i.e. RTC unit) when the electronic device is shut down.

It can be appreciated by a person of ordinary skill in the art that the invoking of the NTP service may be implemented using any appropriate technologies, the description of which is omitted herein.

Figure 5:
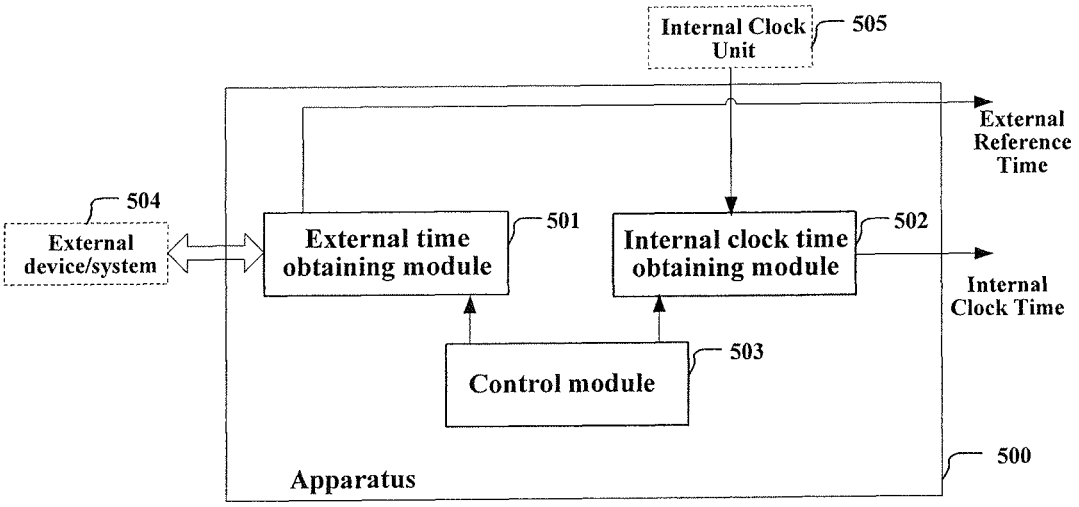
FIG. 5 is a schematic diagram illustrating an apparatus for synchronizing a system time of an electronic device according to an embodiment of the present disclosure.

FIG. 5 is a schematic diagram illustrating an apparatus for synchronizing a system time of an electronic device according to an embodiment of the present disclosure. The apparatus may be embedded in the electronic device, or may be separated from but connected with the electronic device.

As shown in FIG. 5, the apparatus 500 may include an external time obtaining module 501, an internal clock time obtaining module 502 and a control module 503.

The control module 503 may be operably connected with the external time obtaining module 501 and the internal clock time obtaining module 502, respectively, so as to control the two modules 501 and 502. The connection between the modules may be implemented by any appropriate mode, and should not be limited to any particular examples or embodiments.

The external time obtaining module 501 is adapted to obtain an external reference time, for example, from an external device/system 504 connected with the apparatus or the electronic device. The apparatus or the electronic device may be connected to the external device/system 504 in a wired or wireless manner according to any appropriate technology, the description of which is omitted here.

In an example, a communication device (e.g. a communication interface) may be built in the apparatus for synchronizing the system time of the electronic device, or may be built in the electronic device and connectable to the apparatus. The communication device may be connectable with the external device/system in a wired or wireless manner. For example, the communication device may connect the apparatus/electronic device to a communication network in a wired or wireless manner. The communication network may be any appropriate network via which an external reference time may be obtained by the electronic device, the description of which is omitted. The communication device may be implemented using any appropriate technologies, the description of which is also omitted.

The process of obtaining an external reference time may be implemented using any appropriate technologies.

In an example, the external time obtaining module 501 may invoke an NTP service via the communication network to obtain an NTP time as the external reference time. It can be appreciated by a person of ordinary skill in the art that the invoking of the NTP service may be implemented using any appropriate technologies, the description of which is omitted herein.

In another embodiment, the external time obtaining module 501 may be associated with, for example, a GPS receiving device to obtain a GPS time as the external reference time. In an example, the GPS receiving device may be built in the apparatus or the electronic device. In this case, the external time obtaining module may obtain the GPS time directly from the GPS receiving device. Alternatively, the GPS receiving device may be separated from but connected with the apparatus or the electronic device, for example, via a communication network. In this case, the external time obtaining module 501 may obtain the GPS time from the GPS receiving device via the communication network. It can be appreciated by a person of ordinary skill in the art that the GPS time may be obtained using any appropriate technologies, the description of which is omitted herein.

It will be recognized by a person of ordinary skill in the art that the above description regarding the structural features, such as the communication device, the GPS receiving device and the like, may be applicable to any appropriate embodiments regarding methods/apparatus for synchronizing a system time of an electronic device. For the sake of succinctness, they are omitted in the description of some embodiments disclosed herein.

The control module 503 is adapted to disable the external time obtaining module 501 when the electronic device is booting up, and to enable the external time obtaining module 501 when the electronic device has booted up and is connected with the external device/system.

The internal clock time obtaining module 502 is adapted to obtain an internal clock time from an internal clock unit 505, for example, an RTC unit, of the electronic device and use the internal clock time, for example, an RTC time, as a system time of the electronic device.

In the embodiment, when the electronic device is booting up, the control module 503 may control the internal clock time obtaining module 502 to obtain an internal clock time and use the obtained internal clock time as the system time of the electronic device, while disabling the external time obtaining module 501. In other words, the obtaining of an external reference time is delayed until the electronic device has booted up and its connection with the external device/system is available. With the solution, the probability of fault in the electronic device during execution of the booting up process is reduced without decreasing the boot-up speed of the electronic device and even increasing the boot-up speed thereof.

Figure 6:
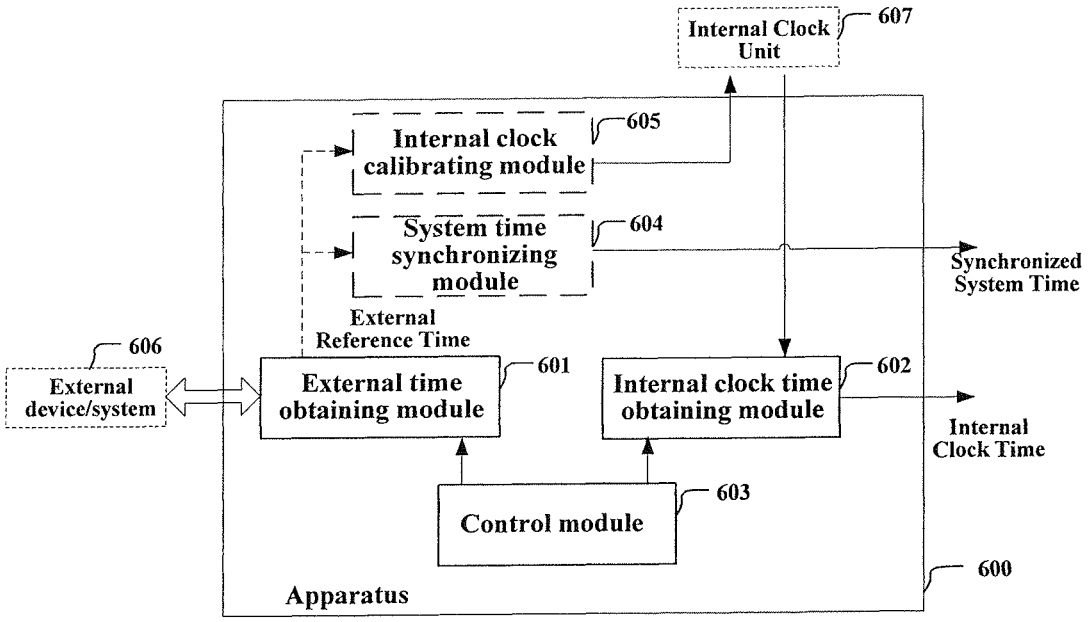
FIG. 6 is a schematic diagram illustrating an apparatus for synchronizing a system time of an electronic device according to another embodiment of the present disclosure.

FIG. 6 is a schematic diagram illustrating an apparatus 600 for synchronizing a system time of an electronic device according to another embodiment of the present disclosure. In the embodiment, the apparatus includes an external time obtaining module 601, an internal clock time obtaining module 602, and a control module 603, which are similar to the modules 501-503 as shown in FIG. 5. The apparatus further includes a system time synchronizing module 604 adapted to synchronize the system time of the electronic device with the external reference time obtained by the external time obtaining module 601.

In an example, the apparatus may further include an internal clock calibrating module 605 adapted to calibrate the internal clock unit 607 of the electronic device using the external reference time obtained by the external time obtaining module 601.

In an example, the external time obtaining module 601 may be adapted to obtain the external reference time periodically or at predefined time points(s). Alternatively, the external time obtaining module 601 may be initiated in response to receipt of an external command, for example, from a user at the electronic device, for example, by receiving an indication of a pressing of a button on the apparatus or the electronic device or by receiving a command at the apparatus or the electronic device. The system time synchronizing module 604 may be adapted to synchronize the system time of the electronic device periodically or at the predefined time point(s) or after the external time obtaining module 601 is initiated and obtains an external reference time in response to the external command, with the external reference time obtained by the external time obtaining module, and the internal clock calibrating module 605 may be adapted to calibrate the internal clock unit 607 of the electronic device periodically or at the predefined time point(s) or after the external time obtaining module 601 is initiated and obtains an external reference time in response to the external command. In this way, the electronic device may keep its system time synchronized with the external device/system 606.

In an example, the control module 603 may be further adapted to disable the external time obtaining module 601 when the apparatus/electronic device becomes disconnected from the external device/system 606 (e.g. the communication network) or the connection therebetween becomes unstable and enable the external time obtaining module 601 when the apparatus/electronic device resumes its connection with the external device/system 606 (e.g. the communication network) and the connection therebetween becomes stable. In this way, the resources of the electronic device may be saved and accordingly the performance of the electronic device may be improved.

The control module 603 may be operably connected with the external time obtaining module 601 and the internal clock time obtaining module 602, respectively, so as to control the two modules 601 and 602. The system time synchronizing module 604 may be operably connected with the external time obtaining module 601 to obtain the external reference time therefrom. The internal clock calibrating module 605 may also be operably connected with the external time obtaining module 601 to obtain the external reference time therefrom. The connection between the modules may be implemented by any appropriate mode, and should not be limited to any particular examples or embodiments.

In the above embodiments/examples, the electronic device may be an embedded electronic device, such as a digital camera, a Personal Digital Assistance (PDA), a mobile phone, a home appliance or the like.

In addition, the method and apparatus, as well as the modules therein, for synchronizing a system time of an electronic device according to the embodiments of the disclosure may be implemented by a program product or a set of program instructions that can be operated on any information processing device. The information processing device may be any appropriate processing device, such as a computer, a handheld device, or an embedded device or the like. Therefore, such program product or program instructions, as well as machine-readable medium storing the program product or program instructions thereon, also constitute part of the disclosure. The machine-readable medium may include any existing and future storage medium.

Furthermore, each of the modules/components in the above described apparatuses, such as the external time obtaining module 501/601, the internal clock time obtaining module 502/602, the control module 503/603, the system time synchronizing module 604, and the internal clock calibrating module 605, may be realized as a software unit that can be operated on a chip, or may be realized by a specialized circuit, e.g. a single chip or the like. Therefore, such software units and/or circuits (e.g. chips) also constitute part of the disclosure.

It can be understood by a person of ordinary skill in the art that there is little distinction left between hardware and software implementations of the aspects of the apparatus described above; the use of hardware or software is generally (but not always, in that in certain contexts the choice between hardware and software can become significant) a design choice representing cost vs. efficiency tradeoffs. There are various vehicles by which processes and/or apparatuses and/or other technologies described herein can be effected (e.g., hardware, software, and/or firmware), and that the preferred vehicle will vary with the context in which the processes and/or apparatuses and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or internedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" or "comprising" should be interpreted as "including but not limited to," the term "having" should be interpreted as "having at least," the term "includes" or "comprises" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to disclosures containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for synchronizing a system time in an electronic device, comprising:

when the electronic device is executing a boot process, disabling an external time obtaining function of the electronic device for obtaining an external reference time, obtaining an internal clock time, and synchronizing the system time of the electronic device with the internal clock time; and when the electronic device has completed the boot process, enabling the external time obtaining function to obtain the external reference time.

2. The method according to claim 1, wherein after enabling the external time obtaining function, the method further comprises:

obtaining, by the external time obtaining function, the external reference time via a communication network.

3. The method according to claim 2, further comprising:

disabling the external time obtaining function when connection between the electronic device and the communication network is unavailable, and enabling the external time obtaining function when the connection between the electronic device and the communication network is available.

4. The method according to claim 2, wherein the external reference time is a Network Time Protocol (NTP) time, and the external time obtaining function obtains the NTP time by invoking an NTP service via the communication network.

5. The method according to claim 1, further comprising:

synchronizing the system time of the electronic device with the obtained external reference time.

6. The method according to claim 1, further comprising:

calibrating the internal clock unit using the obtained external reference time.

7. The method according to claim 1, further comprising:

performing the external time obtaining function to obtain the external reference time periodically, or at predefined time points, or in response to an external command; and synchronizing the system time of the electronic device with the obtained external reference time periodically, or at predefined time points, or in response to an external command.

8. The method according to claim 1, wherein the external reference time is a Global Position System (GPS) time, and the external time obtaining function obtains the GPS time by using a GPS receiving device associated with the electronic device.

9. An apparatus for synchronizing a system time in an electronic device, comprising:

an external time obtaining module, adapted to obtain an external reference time;

an internal clock time obtaining module, adapted to obtain an internal clock time from an internal clock unit of the electronic device and use the internal clock time as the system time of the electronic device; and a control module, adapted to disable the external time obtaining module when the electronic device is executing a boot process, and enable the external time obtaining module when the electronic device has completed the boot process to obtain the external reference time.

10. The apparatus according to claim 9, wherein:

the external time obtaining module is further adapted to obtain the external reference time via a communication device connectable to a communication network.

11. The apparatus according to claim 10, wherein:

the control device is further adapted to disable the external time obtaining module when connection between the electronic device and the communication network is unavailable and enable the external time obtaining module when the connection between the electronic device and the communication network is available.

12. The apparatus according to claim 10, wherein the external reference time is a Network Time Protocol (NTP) time, and the external time obtaining module is adapted to invoke an NTP service via the communication network to obtain the NTP time.

13. The apparatus according to claim 9, further comprising:

a system time synchronizing module, adapted to synchronize the system time of the electronic device with the external reference time obtained by the external time obtaining module.

14. The apparatus according to claim 9, further comprising:

an internal clock calibrating module, adapted to calibrate the internal clock unit of the electronic device using the external reference time obtained by the external time obtaining module.

15. The apparatus according to claim 9, wherein:

the external time obtaining module is further adapted to obtain the external reference time periodically, or at predefined time points, or in response to an external command;

the system time synchronizing module is further adapted to synchronize the system time of the electronic device with the obtained external reference time periodically, or at predefined time points, or in response to an external command.

16. The apparatus according to claim 9, wherein the external reference time is a Global Position System (GPS) time, and the external time obtaining module is adapted to obtain the GPS time using a GPS receiving device associated with the external time obtaining module.

17. The apparatus according to claim 9, wherein the apparatus is embedded in the electronic device.

18. The apparatus according to claim 9, wherein the electronic device is an embedded electronic device.

19. A non-transitory computer-readable medium having stored thereon machine-readable program code for, when executed by a processor, causing an information processing device to perform a method comprising:

when an electronic device is executing a boot process, disabling an external time obtaining function of the electronic device for obtaining an external reference time, obtaining an internal clock time, and synchronizing a system time of the electronic device with the internal clock time; and when the electronic device has completed the boot process, enabling the external time obtaining function to obtain the external reference time.

* * * * *